US005317967A

United States Patent [19]

Heidenreich

[11] Patent Number: 5,317,967

[45] Date of Patent: Jun. 7, 1994

[54] METHOD AND APPARATUS FOR APPLYING PRINTING TO AN AT LEAST PARTIALLY CONICAL ARTICLE

[75] Inventor: Horst Heidenreich, Kirchlengern, Fed. Rep. of Germany

[73] Assignee: Werner Kammann Maschinenfabrik GmbH, Fed. Rep. of Germany

[21] Appl. No.: 945,298

[22] Filed: Sep. 15, 1992

[30] Foreign Application Priority Data

Oct. 1, 1991 [DE] Fed. Rep. of Germany ..... 4132668

[51] Int. Cl.[5] ..... B41F 17/08

[52] U.S. Cl. ..... 101/38.1; 101/40.1; 101/127.1

[58] Field of Search ..... 101/35–41, 101/44, 123, 124, 126, 115, 129, 127.1, 128

[56] References Cited

U.S. PATENT DOCUMENTS

| | | | |
|---|---|---|---|
| 2,127,128 | 8/1938 | Martin | 101/38.1 |
| 2,605,700 | 8/1952 | Martin | 101/35 |
| 3,146,704 | 9/1964 | Johnson | 101/38.1 |
| 3,172,357 | 3/1965 | Rudolph et al. | 101/126 |
| 3,363,546 | 1/1968 | Johnson | 101/38.1 |
| 3,390,756 | 7/1968 | Edwards et al. | 198/802 X |
| 3,398,678 | 8/1968 | Usko | 101/38.1 |
| 3,525,303 | 8/1970 | Cummings | 101/35 |
| 4,572,068 | 2/1986 | Herra Giammattei et al. | 101/35 |
| 4,967,822 | 2/1986 | Heidenreich et al. | 101/38.1 |

FOREIGN PATENT DOCUMENTS

| | | |
|---|---|---|
| 2940133A1 | 6/1981 | Fed. Rep. of Germany . |
| 3338549A1 | 5/1984 | Fed. Rep. of Germany . |

*Primary Examiner*—Edgar S. Burr
*Assistant Examiner*—Stephen R. Funk
*Attorney, Agent, or Firm*—Howson & Howson

[57] ABSTRACT

In a method and apparatus for applying printing or decoration to the conical surface of an article using screen printing, the screen printing stencil performs a pivotal movement during the printing operation in a plane extending parallel to the longitudinal axis of the article to be printed upon. The stencil moves on a path of movement which substantially corresponds at least over a part of its periphery to the peripheral surface of a truncated cone whose cone angle is the same as that of the conical surface.

16 Claims, 6 Drawing Sheets

METHOD AND APPARATUS FOR APPLYING PRINTING TO AN AT LEAST PARTIALLY CONICAL ARTICLE

BACKGROUND OF THE INVENTION

There are a number of situations which involve applying printing such as a print image to an article of a conical configuration or an article which has at least a conical portion. Such an article may be for example a container such as a bottle which serves for packaging purposes. In many cases the transition between the actual body of a bottle or similar article and the end of the bottle which has the opening thereof is of a conical configuration. However, in consideration of the large number of shapes which are nowadays often employed precisely in the packaging field, use is also made of containers which are of a substantially conical configuration over the major part of their axial extent and possibly even over their entire length. When at any event using a screen printing procedure, printing is applied to curved surfaces generally by a mode of operation in which the surfaces are rolled against the screen printing stencil. In that operation, in order to guarantee a good print result or a clear print image, the speed at which the surface to which the printing is to be applied is moved during the printing operation corresponds to the speed at which the screen printing stencil is moved. In that respect, the cross-section of the article does not necessarily have to be of a rotationally symmetrical configuration in the region in which the printing or print image is to be applied. It is sufficient that that region of the peripheral surface of the article, to which the printing is to be applied, can be moved with a rolling action against the screen printing stencil, during the printing operation.

From the printing procedure point of view, a conical configuration of an article or a portion thereof, to which printing is to be applied, presents a particularity insofar as the individual regions of different diameters of the conical article or portion move at different peripheral speeds in such a way that, for a given angular speed, the peripheral speed increases with increasing diameter of the respective region of the article. That must be taken into account in relation to the rolling movement as between the article and the screen printing stencil, during the printing operation, with the result that, during the printing operation, the portion of the screen printing stencil which bears the print to be applied to the article performs a movement along a circular arc whose radius decreases with decreasing cone angle, that is to say the angle between the longitudinal axis of the article to be printed upon, and the surface to which the printing is to be applied.

A further particularity in terms of printing on conical or partially conical articles is that, when the article is arranged horizontally, during the operation of applying printing thereto, the portion of the conical surface which is to be provided with the printing in the printing operation and which is disposed opposite the squeegee or doctor member that co-operates with the screen printing stencil, extends at an acute angle relative to the horizontal. A similar point apply when printing on an article when the longitudinal axis thereof extends vertically. As, during the printing operation, the respectively co-operating regions of the screen printing stencil and the article, at any event under the effect of the squeegee or doctor member, extend parallel to each other and normally at a very small spacing from each other but possibly in contact with each other, then, when the article is arranged horizontally or vertically, the screen printing stencil must also be arranged inclinedly in such a way as to correspond to the inclined positioning of the cone surface to be printed upon, at any event if a high-quality print result is to be achieved. That gives rise to certain difficulties, more especially in particular when the articles to be printed upon are transported through the screen printing machine in quick succession and thus at small spacings from each other. In modern machines, in order to achieve an adequate level of productivity, it is the usual practice for the articles to be transported automatically through the printing machine, in particular when a plurality of print items or images are to be successively applied to produce a combined or overall print image on the article. Admittedly, there is theoretically the possibility of eliminating the difficulties caused by the inclined positioning of the surface to be printed upon, by positioning the article in the printing operation in such a way that the respective region of the surface to be printed upon, which is in contact with the screen printing stencil, extends for example horizontally. That also permits the screen printing stencil to be disposed substantially horizontally. However, inclined positioning of the article in the printing station always results in complication in terms of handling of the article in the printing machine, and that either results in adverse effects on the level of productivity or requires the provision of highly complicated pieces of equipment which make the apparatus susceptible to trouble. It is therefore generally to be preferred that, in the printing operation, the article occupies a position in which its longitudinal axis extends at least substantially horizontally, especially as it is frequently the case that, at the same time as printing is applied to the conical surface, printing is also to be applied to cylindrical or other surfaces, in relation to which the use of a stencil which is movable in a horizontal plane is also preferred. In the present day apparatuses, that means that a pivotable screen printing stencil must be arranged inclinedly to correspond to the positioning of the surface to be printed upon, that is to say it must be disposed relative to the horizontal at an angle which is the same as the cone angle of the surface. However that arrangement requires a certain amount cf space to be available in the printing station on each side of the article as the fact that the axis about which the screen printing stencil performs a pivotal movement is inclined corresponding to the cone angle of the article means that the path of movement of the stencil extends at each side of the article to be printed upon into the regions disposed at each side of the article, beside same, with the result that those regions must be left free in the printing operation. That excludes the possibility of the articles being passed through the screen printing apparatus and the printing stations in quick succession, with possibly only a spacing of a few millimeters from each other.

SUMMARY OF THE INVENTION

An object of the present invention is to provide a method of applying decoration or printing to a conical surface of an article, which can provide an enhanced level of productivity.

Another object of the present invention is to provide a method of applying decoration to a conical surface using a screen printing stencil pivotable in a plane parallel to the longitudinal axis of the article to be printed upon.

Still another object of the present invention is to provide a method of applying printing to a conical surface of an article which is disposed horizontally during the printing operation using a printing stencil pivotable about an axis which can extend vertically irrespective of the angle between the surface to be printed upon and the longitudinal axis of the article so that the stencil does not exceed a given position in respect of height, which is above the region of movement of the articles, irrespective of the angular position adopted by the stencil during the printing operation.

A still further object of the present invention is to provide an apparatus for applying decoration to a conical surface of an article which involves a rational sequence of elements of the components and which thereby affords a high level of productivity.

Still a further object of the present invention is to provide an apparatus for printing on a conical surface of an article, which affords enhanced versatility of operation.

The foregoing and other objects are attained by the method and apparatus in accordance with the principles of the present invention.

It will be noted at this point that DE-A-29 40 113 discloses a method of printing on an article, and apparatus for carrying out that method, which, during the printing operation, moves along a path corresponding to the peripheral or generated surface of a truncated cone. However that concerns printing on elongated objects which are moved approximately tangentially past the stencil which rotates about a vertical axis and there is no indication therein about printing on an article of an at least partly conical configuration.

It will be further noted at this point that the present invention can be used in any situations which involve printing on or applying decoration to a conical surface which can h=rolled against a screen printing stencil and whose radius of curvature, in the direction in which the squeegee or doctor member extends, involves a more or less uniform variation. In that respect there is no need for the surface of that nature to extend over 360° . While therefore the present invention will be described in greater detail hereinafter predominantly by reference to printing on or applying decoration to bottles, that is not intended to constitute a limitation on the present invention.

Generally the screen printing stencil will perform reciprocating pivotal elements, with the printing or decoration-applying operation being effected in one direction of movement. It is however also possible for the stencil to be caused to rotate only in one direction, possibly with a stepwise action.

Further objects, features and advantages of the invention will be apparent from the following description of a preferred embodiment.

DESCRIPTION OF THE PREFERRED EMBODIMENT

Figure 1:
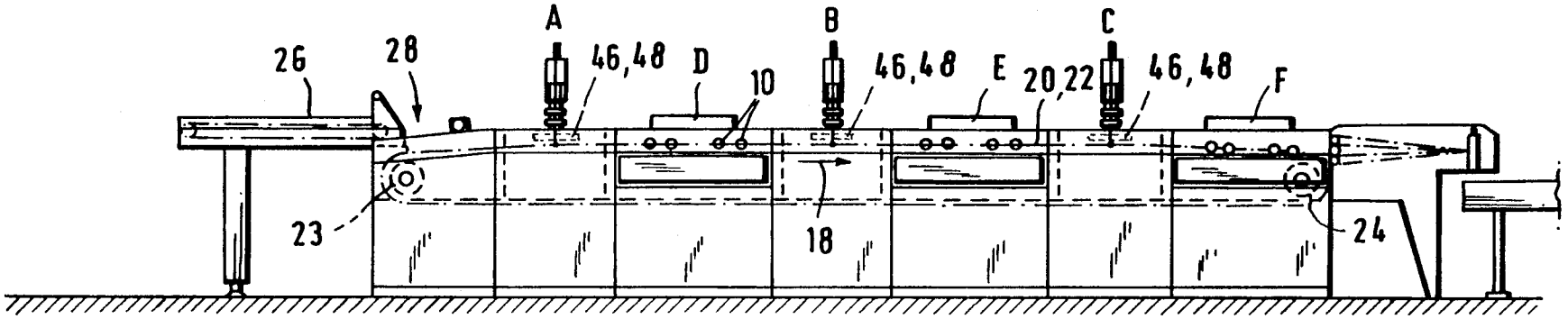
FIG. 1 is a diagrammatic front view of a screen printing apparatus.
Figure 2:
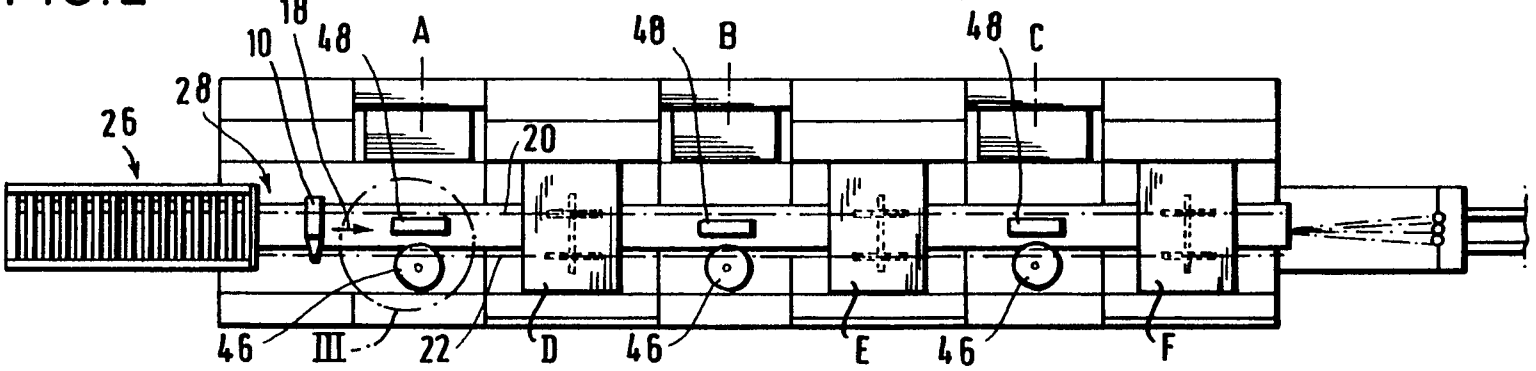
FIG. 2 is a plan view of the FIG. 1 apparatus.
Figure 9:
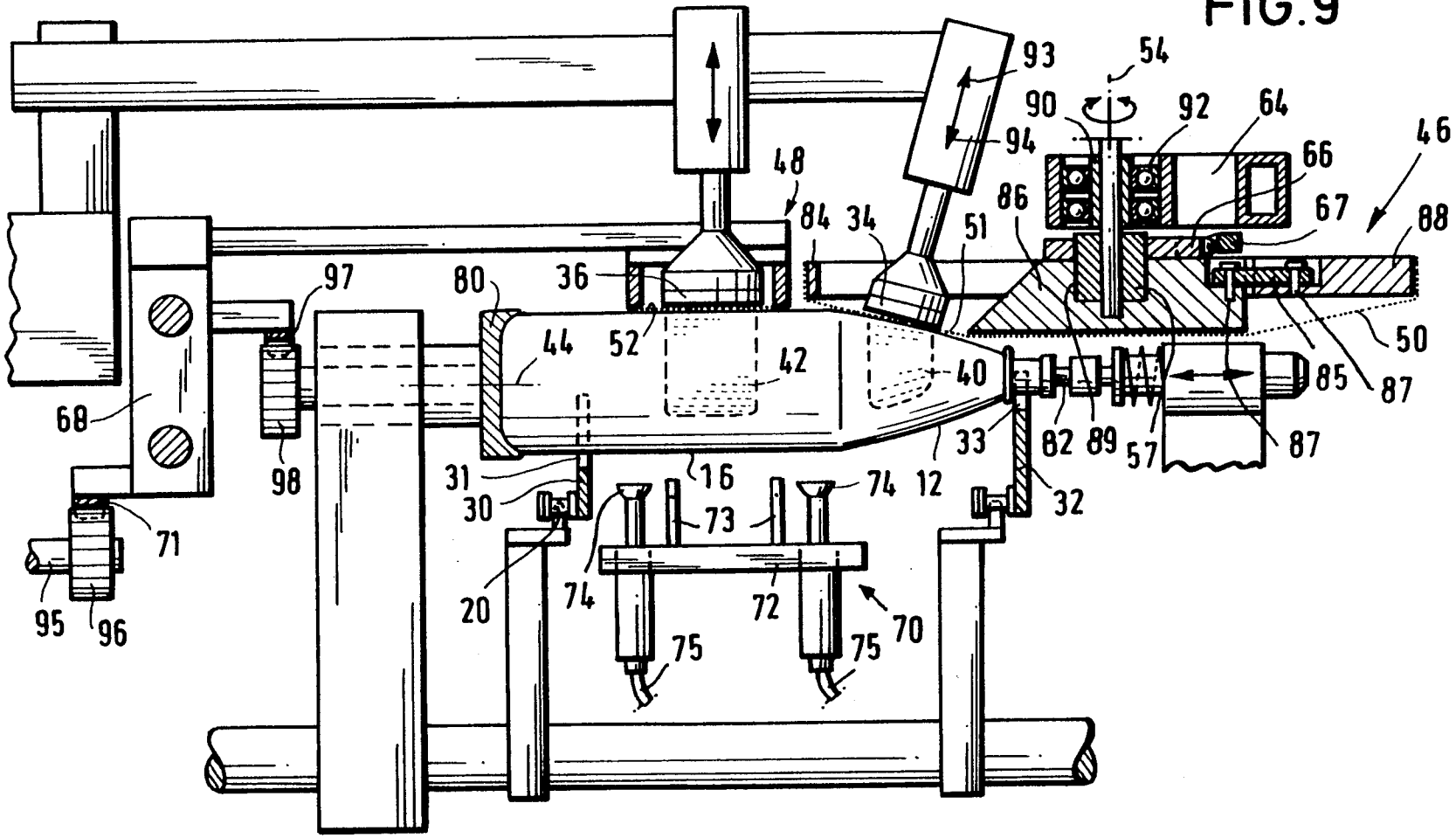
FIG. 9 is a view in section taken along line IX—IX in FIG. 8.

Referring firstly to FIGS. 1 and 2, a screen printing apparatus as illustrated therein comprises first, second and third printing stations as indicated at A, B and C, each of which has first and second screen printing stencils for applying first and second partial images or image components, wherein each three image components combine on the article to which the printing is applied to form an overall image. The articles to be printed upon or to which decoration is to be applied, in the present case, are bottles 10 which can also be more clearly seen for example in FIGS. 3 and 4 and which each comprise a neck portion 12 which tapers in a substantially conical configuration towards the opening 14 of the respective bottle. FIG. 9 shows that the peripheral surface of the neck portion 12 of each bottle does not need to be of a precisely linearly extending configuration in longitudinal section but on the contrary it may be curved slightly outwardly and is thus convex or it may possibly also be of a slightly concave configuration. That however is not a disadvantage because the screen printing stencil can readily adapt to minor deviations from the straight configuration in that kind, under the effect of the squeegee member which co-operates with the stencil, as will be described hereinafter. Looking still at FIGS. 3 and 4, the body of the bottle 10 is extended at an end of the neck portion 12 which is remote from its opening 14, in a substantially cylindrical portion 16. Both the conical neck portion 12 and the cylindrical portion 16 are to be provided with a respective print image or decoration, each of which is to be applied by three printing steps.

Figure 3:
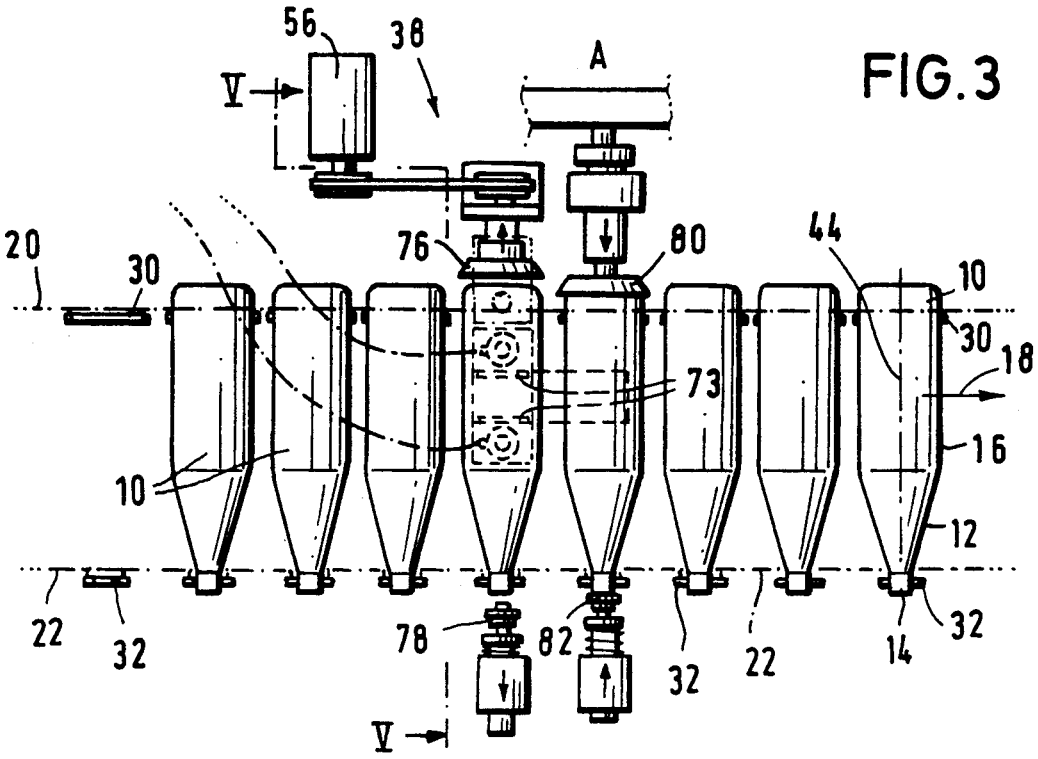
FIG. 3 is a plan view of bottles disposed in the region of a printing station of the apparatus, although the stencils and associated components have been omitted for the sake of clarity of the view.
Figure 4:
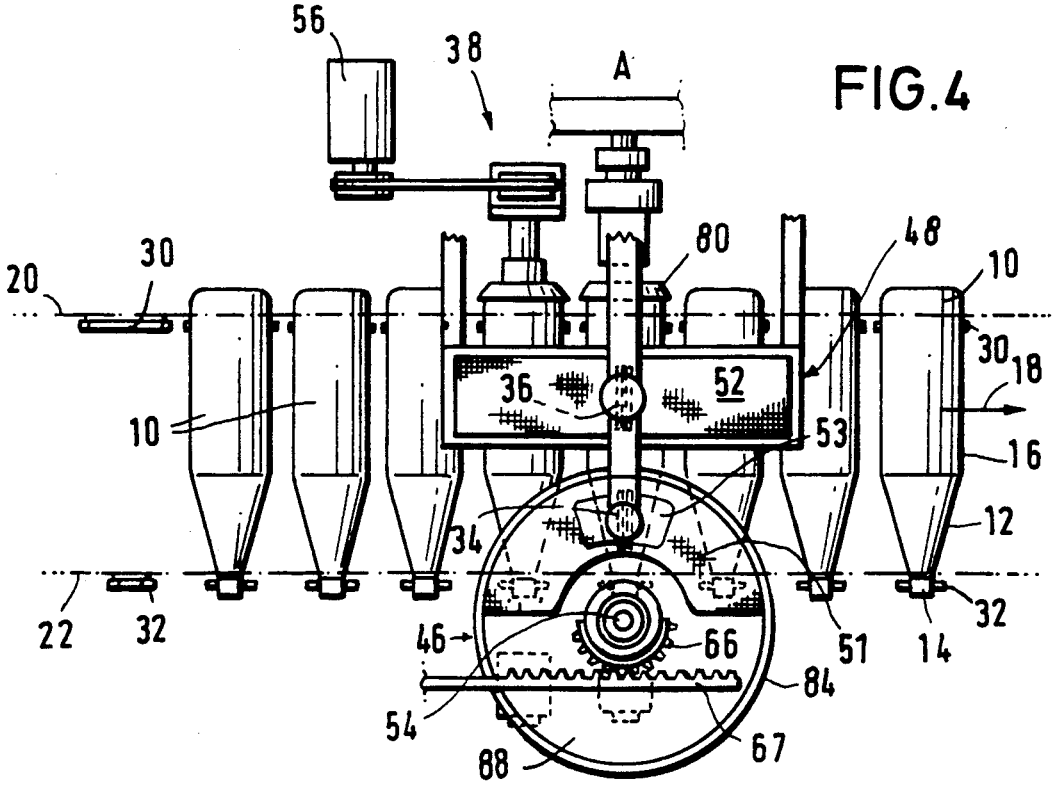
FIG. 4 is a view corresponding to that shown in FIG. 3 but with the two screen printing stencils associated with each printing station.

The bottles 10 to be printed upon are transported through the screen printing apparatus and the processing stations thereof with a stepwise motion in the direction indicated by the arrow 18 in FIGS. 3 and 4. For that purpose, the apparatus is provided with a first transportation means in the form of a pair of chains as diagrammatically indicated at 20 and 22 which each circulate in a respective vertical plane. Disposed at both ends of the apparatus are direction-changing or guide wheels 23, 24 of which at least one pair also serves for driving the chains 20, 22.

The bottles 10 are supplied by way of a delivery device 26 disposed upstream of the actual screen printing apparatus and passed on to the pair of chains 20, 22 at the delivery station 28. For that purpose each chain 20, 22 is provided with receiving elements indicated at 30 and 32 in FIGS. 3 and 4 having recesses as indicated at 31 and 33 in FIGS. 5, 6 and 9 which are adapted to the cross-sectional shape of the respective portion of the bottle 10, which is to be accommodated therein. The receiving elements 30 and 32 are so arranged that each two mutually oppositely disposed receiving elements 30 and 32 jointly carry a respective bottle 10. The receiving elements which are not shown in FIGS. 1 and 2 are disposed at such short spacings from each other, in the direction of movement of the chains 20, 22, that there is a spacing of possibly only a few millimeters between two adjacent bottles which are carried by the chains 20, 22.

Figure 5:
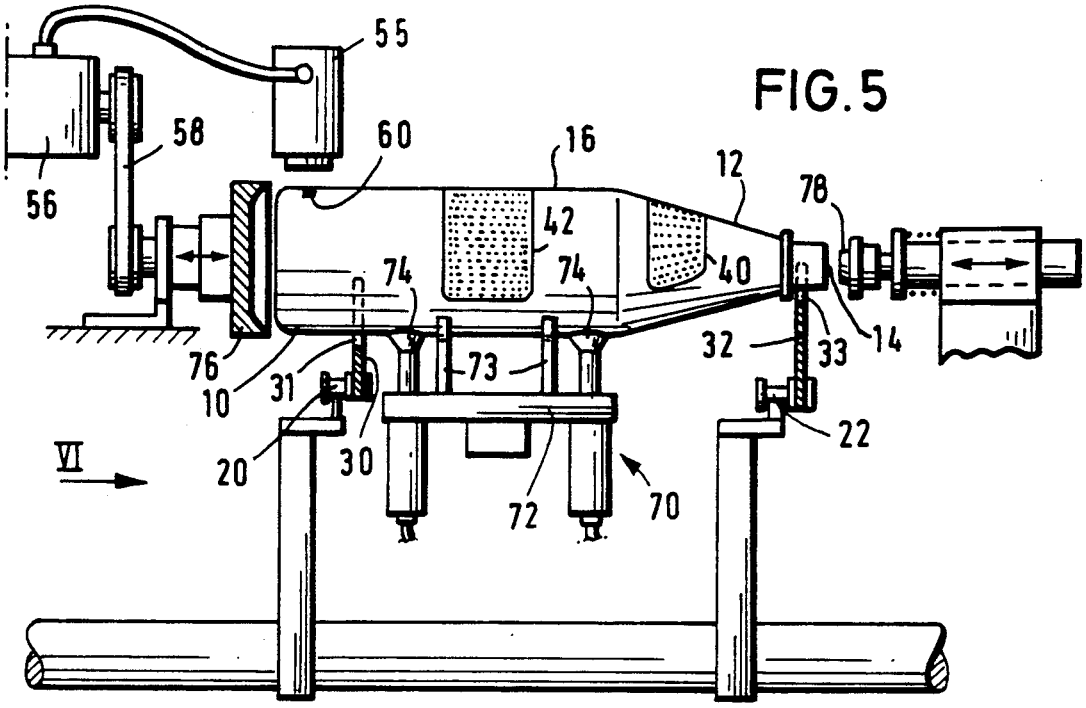
FIG. 5 is a view in section taken along line V—V in FIG. 3.

Arranged downstream of each of the printing stations A, B and C in the transportation direction 18 is a drying station through which the bottles 10 pass after they have each been provided with two separate image components as indicated at 40 and 42 in FIG. 5.

Thus, a drying station D is provided downstream of printing station A; a drying station E is provided downstream of printing station B; and a drying station F is provided downstream of printing station The above-described arrangements and configurations of the apparatus are generally known so that there is no need for them to be described in greater detail at this point. It is also possible to use other apparatus configurations and arrangements, depending on the respective circumstances involved. Thus for example, depending on the nature of the article to be printed upon, the choice of printing inks or like decorative agents and possibly other factors, it is possible to omit drying stations. On the other hand it is possible to provide additional treatment stations, for example for flame treatment of or removing static electricity from the articles.

Disposed at each of the three printing stations A, B and C are first and second printing devices 46 and 48 of which the device 46 serves for printing on or applying decoration to the conical neck portion 12 and the device 48 serves for printing on or applying decoration to the cylindrical body portion 16. Each of the two printing devices 46, 48 is provided with a respective screen printing stencil 50 and 52 and a squeegee member 34 and 36 co-operating therewith. As the screen printing device 48 serves to apply printing to the cylindrical portion 16 of the bottle 10, there is no need for a detailed description thereof as that is a device of conventional design. During the printing operation the screen printing stencil 52 of the device 48 is displaced relative to the 10 transversely to the longitudinal axis of the bottle, which rotates about its longitudinal axis but which in other respects is stationary, as is conventional practice in regard to printing on cylindrical articles.

During the printing operation, as in the transportation movement in the direction of the arrow 18, the bottle 10 is arranged in a lying position so that its longitudinal axis extends horizontally. Consequently, the generated or peripheral surface of the conical portion 12 in longitudinal section is disposed at an acute angle relative to the longitudinal axis as indicated at 44 of the bottle 10, as can be seen for example from FIG. 9. As at least that region of the screen printing stencil 50 of the device 46, which carries the print image must extend at least substantially parallel to the peripheral surface of the portion 12 during the operation of printing thereon, the region 51 of the stencil 50, which carries the print image 53, forms the peripheral surface of a truncated cone whose cone angle corresponds to the cone angle of the neck portion 12 of the bottle, when the longitudinal axis 54 of the printing device 46, which at the same time forms the axis of rotation for that device, is in a vertical position. FIG. 9 in particular clearly shows the relative position of the bottle 10 with the conical neck portion 12 and the printing device 46 with the region 51 of screen printing stencil 50.

As, in the case of the illustrated embodiment, each bottle 10 is to be provided with a plurality of image components 40 and 42 both on the conical neck portion 12 and also on the cylindrical portion 16, which image components combine to for a total or complete print image, it is necessary to guarantee that, in each printing station A, B and C, the bottle 10 is oriented in the peripheral direction in a specific fashion relative to the respectively associated screen printing stencils 50 and 52 and thus the respective image to be applied at that station. Furthermore, particularly when dealing with rotationally symmetrical articles, the print image is frequently to be applied to a specific peripheral region of the article, for example when the image does not extend over the entire periphery of 360° of the article, in order for instance to take account of the existence of seams or other markings which may be present on the outside of the bottle and which may occur for example in the course of production thereof. Therefore, for the purposes of orientation of the bottle in the peripheral direction, a matching or orientation station 38 for putting the respective bottles into the appropriate orientation is disposed a transportation step upstream of each of the respective printing stations A, B and C in the direction of transportation movement 18.

Figure 6:
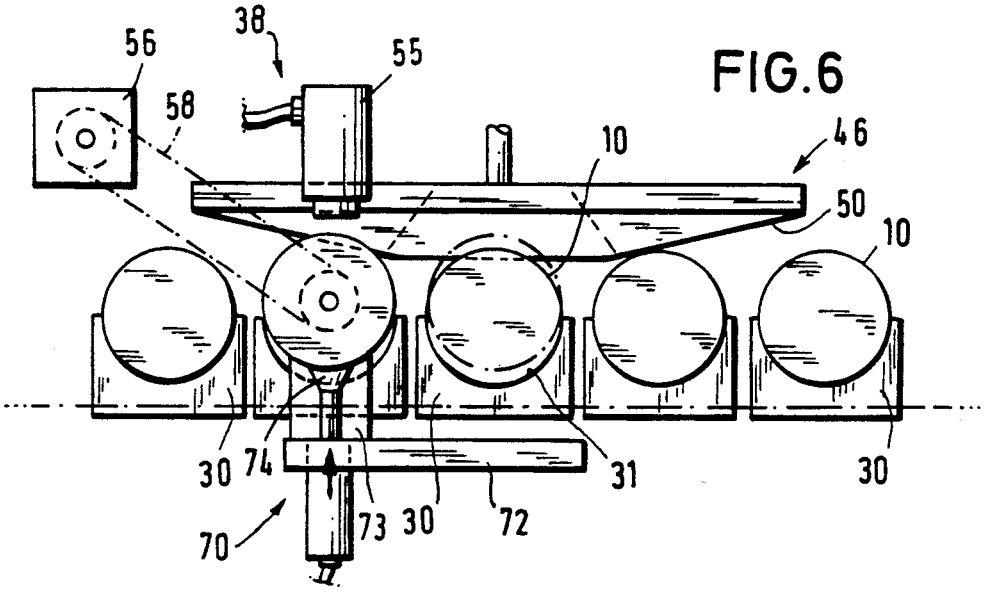
FIG. 6 is a view in the direction indicated by the arrow VI in FIG. 5, with an additional transportation means in the starting position at the beginning of a transportation step.

In addition, looking at for example FIGS. 5 and 6, associated with each printing station A, B and C is an additional transportation device 70 which essentially comprises a carrier 72 provided on its top with first and second receiving or mounting elements 73 and first and second suction cups 74 which are each disposed at a spacing from each other in a vertical plane extending transversely to the transportation direction 18; that spacing depends on the dimensions of the article to which printing or decoration is to be applied. The receiving elements 73 correspond in terms of their function and configuration to the receiving elements 30 and 32 on the chains 20 and 22. The two suction cups are connected to a reduced pressure or vacuum source (not shown) by way of hoses indicated at 75 in FIG. 9.

The transportation device 70 can be moved up and down and reciprocated in the transportation direction 18 and in the opposite direction thereto by suitable drive means (not shown). The distance by which the transportation device 70 is movable in the direction 18 and in the opposite direction corresponds to the spacing between the matching station 38 and the respectively associated printing station. The transportation device 70 serves to transport the bottle 10 into the associated printing station after it has been suitably oriented in the peripheral direction in the upstream-disposed matching station 38, while retaining the bottle 10 in that oriented position.

Upstream of each printing station A, B and C the bottles 10 which are transported with a stepwise motion through the screen printing apparatus by the pair of chains 20 and 22 firstly pass into the respective matching station 38, in which respect it is possible in conventional manner to carry out additional treatment operations upstream of the first printing station A in the transportation direction 18 or upstream of the associated matching station, and subsequently possibly also between the following printing stations B and C. Associated with each station 38 is a holder which in the illustrated embodiment comprises two members 76 and 78 which can be seen for example from FIG. 5. At the end of the transportation stepping movement produced by the pair of chains 20 and 22, a respective bottle 10 is disposed in a position between the two holder members 76 and 78 but not in precisely coaxial relationship therewith but displaced downwardly by a small distance of for example between 1 and 2 mm. During transportation of the bottle 10 by the chains 20 and 22, the two holder members 76 and 78 are at a spacing from each other which permits the bottle to be moved into the above-described position between the two holder members 76 and 78. As soon as that position has been reached, the distance between the two holder members 76 and 78 is reduced by suitable axial displacement thereof, so that the bottle 10 is engaged by the two holder members in the usual way, that is to say, the holder member 76 embraces the region of the bottom of the bottle 10 and the holder member 78 engages into the opening of the bottle 10. When that happens, at the same time the two holder members 76 and 78 cause the bottle 10 to be lifted slightly so that it is aligned with the two holder members 76 and 78 whereby, at the end of the closing movement of the two holder members 76 and 78 towards each other, the bottle 10 is aligned coaxially with respect to the holder members 76 and 78 which now carry it.

Referring now to FIGS. 5 and 6, associated with the station 38 is a sensor 55 which controls a drive indicated at 56 in FIGS. 3 through 6. The drive 56, by way of a belt indicated at 58 in FIGS. 5 and 6, drives the holder member 76 associated with the bottom region of the bottle 10 so that the bottle 10 is rotated about its longitudinal axis, thereby entraining the holder member 78. The bottle 10 is provided with a marking as indicated at 60 in FIG. 5 which is detected by the optical sensor 55 during the rotary movement of the bottle 10 so that the peripheral position of the bottle 10 can be ascertained and the bottle 10 can be moved by controlled rotation about its longitudinal axis into a specific defined orientation which corresponds to the position at which the step of applying the print images in the following printing station is to be begun. The marking 60 may also be any parking which is present in any case on the bottle, for example a mold seam or the like. The items of equipment and operating procedures related to the matching or orientation operation are generally known and conventional practice so that there is no need for them to be described in greater detail here.

Figure 7:
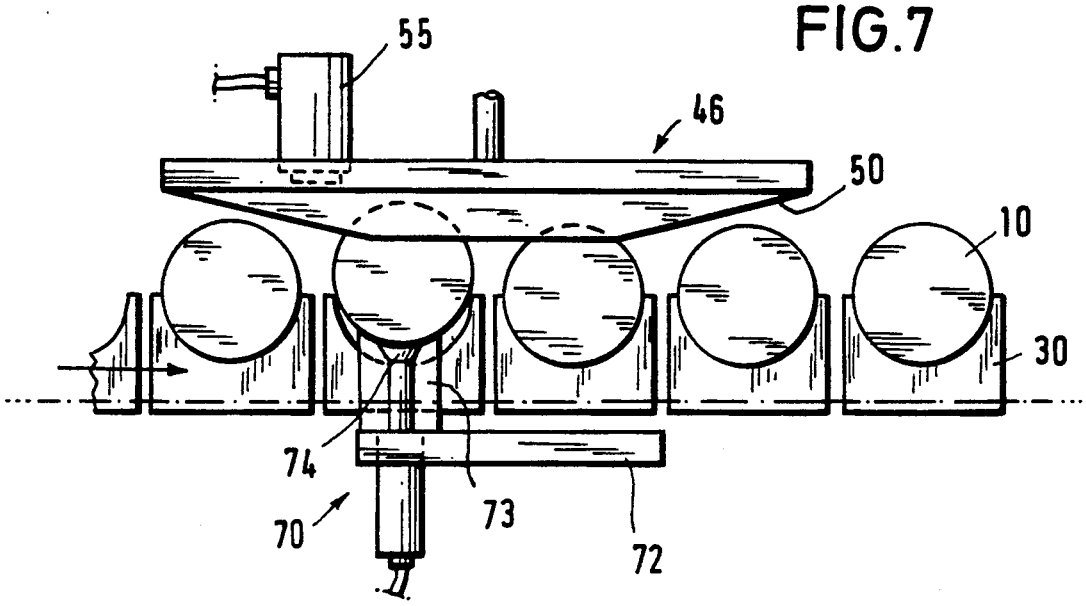
FIG. 7 is a view corresponding to that shown in FIG. 6 with the additional transportation means in an intermediate position.
Figure 8:
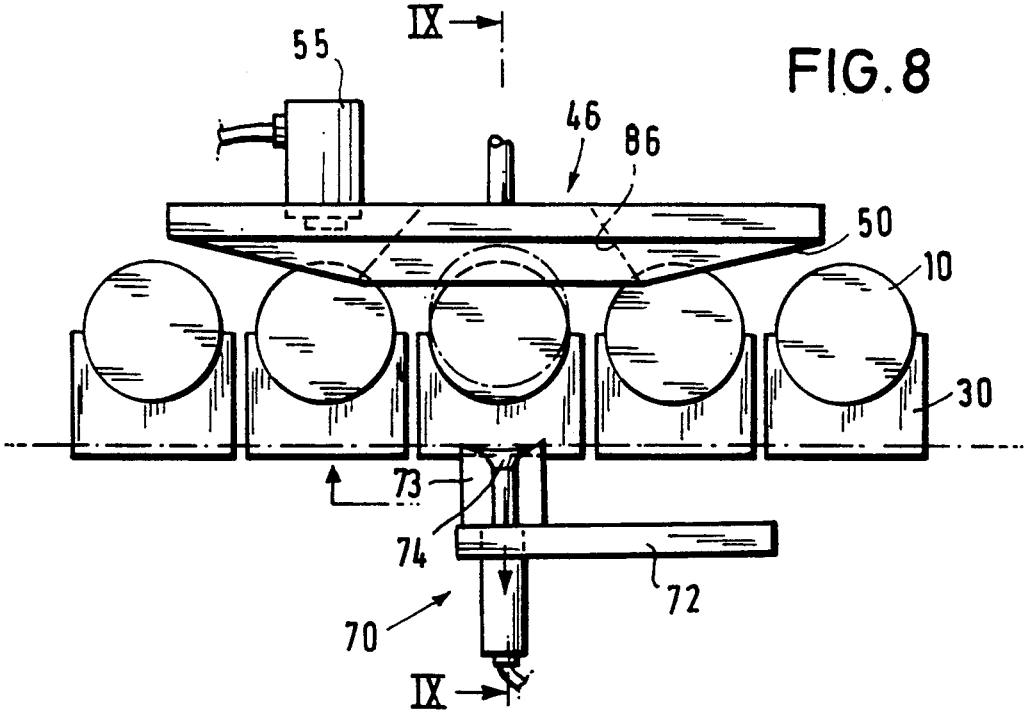
FIG. 8 is a view corresponding to that shown in FIG. 6 with the additional transportation means in a terminal position.

As soon as the bottle 10 has been moved into the correct peripheral position by suitable rotary movement of the two holder members 76 and 78, the transportation device 70 takes over the function of holding the bottle 10, are specifically in its now specific and defined peripheral position. For that purpose the transportation device 70 which at that time is disposed in the matching station 38 but in its lower position as illustrated in FIG. 8 of the drawing is moved out cf that lower position upwardly into the position shown in FIG. 6 in which the two receiving elements 73 and the suction cups 74 bear against the bottle. In that situation, the suction cups 74, by virtue of the suction effect which then takes effect against the bottle 10, prevent the bottle 10 from turning and thus secure it in its aligned position. After the two holder members 76 and 78 have been moved away from each other and have thus released the bottle 10, the transportation device 70 is moved in the transportation direction 18 by a distance which corresponds to the spacing between a matching station 38 and the associated printing station so that, at the end of that transportation stepping movement, the oriented bottle 10 is disposed between first and second holder members as indicated at 80 and 82 in FIG. 9 of a holder operatively associated with the printing station. FIG. 7 shows an intermediate position in the course of the transportation stepping movement from the matching station 38 into the downstream-disposed printing station. The two holder members 80 and 82 essentially correspond to the holder members 76 and 78 of the matching station.

During the transportation stepping movement from the matching station 38 into the subsequent printing station, which is effected by the additional transportation device 70, the bottle 10 is normally disposed at a position in respect of height which corresponds to its heightwise position in the two stations when it is held by the respective holder members 76, 78 and 80, 82 respectively. It will be appreciated that it is also possible if necessary for the transportation device 70 with the bottle 10 carried thereby to be firstly lowered slightly in the matching station 38 before the transportation stepping movement towards the subsequent printing station is performed, with the bottle then being lifted again somewhat in the printing station.

Then, in the printing station, the bottle 10 is picked up in the usual manner by the two holder members 80 and 82 by virtue of a reduction in the spacing therebetween, as is shown for example in FIG. 9. After that, the transportation device 70 is moved downwardly to release the bottle 10, in which case the reduced pressure applied to the suction cups 74 can be switched off and the bottle 10 can then be freely rotated in the course of the following printing operation. That position of the components is illustrated in FIGS. 8 and 9.

The transportation device 70 can then be moved back into the matching station again, in the opposite direction to the transportation direction 18, in order there to pick up the next following bottle in the above-described manner. That bottle had been transported into the matching station by the chains 20, 22 in the preceding transportation stepping movement.

The extent of the vertical movements to be performed by the transportation device 70 is in any case very slight as the only important consideration is that the bottle 10 is to h=lifted upwardly to such an extent that it comes out of contact with the respective holder 30 or 32 on the chains 20 and 22 in order thereby to permit unimpeded rotary movement of the bottle 10 in the matching station 38 and in the respective printing station. As FIGS. 5 and 9 in particular show, the transportation device 70 can be disposed between the two chains 20 and 22 so that it is outside the area of movement of the two chains and the holders 30, 32 carried thereby, and thus also the bottles.

After the printing procedure in the respective printing station has been concluded, the bottle is released by the two holder members 80, 82 by virtue of their being moved away from each other. As the pair of chains 20, 22 with the receiving elements 30, 32 had also been advanced in the direction of the arrow 18 by a transportation stepping movement, during the transportation stepping movement of the transportation device 70, the two receiving elements 30 and 32 out of which the bottle 10 had been lifted by the transportation device 70 in the matching station 38 are now in the printing station so that, when the bottle with printing or decoration applied thereto is released by the holder 80, 82, the bottle falls back down into the two receiving elements 30 and 32 on the chains 20 and 22. That does not give rise to any problems since, as already stated, the distance between the bottle in its raised position and the position occupied by the bottle when it is supported by the two receiving elements 30 and 32 on the chains 20 and 22 is only slight.

Figure 10:
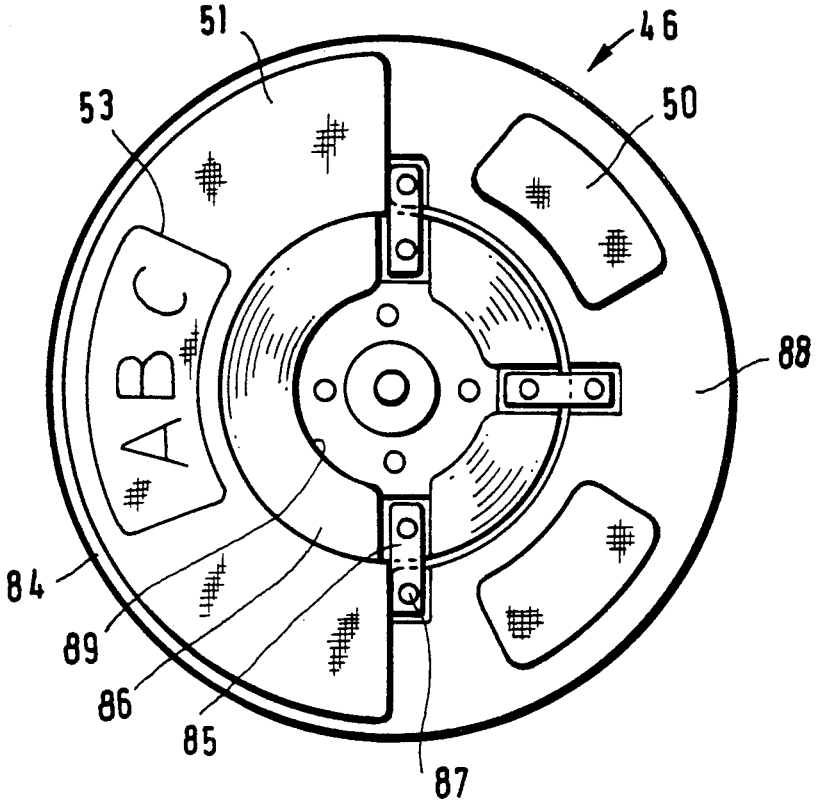
FIG. 10 is a plan view of the frame structure of a screen printing stencil with a stencil mounted and tensioned thereon.

Referring now to FIGS. 4, 9 and 10, the printing device 46 comprises a frame 84 in the general shape of a circular ring, to which the circular screen printing stencil 50 is mounted. The screen printing stencil 50 which is disposed in the frame 84 in a prestressed condition is initially of a flat configuration within the frame 84. The shape of a truncated cone which is adapted to the cone configuration of the neck portion 12 of the bottle 10 is achieved by the arrangement within the frame 84 and in coaxial relationship therewith of an insert member 86 of suitable dimensions, acting as a shaping portion, which projects towards the screen printing stencil 50 in the direction of the axis which extends vertically relative to the plane of the frame 84, while at the same time bearing against the central region of the screen printing stencil 50 in such a way that the stencil 50 assumes the of a truncated cone as shown in FIG. 9, in which the annular region between the frame 84 and the insert member or shaping portion 86 forms the conical surface.

In the illustrated embodiment, for that purpose the frame 84 is provided on its inward side with an integrally disposed holder 88 which in plan view as shown for example in FIG. 10 is in the shape of approximately half an annular disk which is disposed at least substantially coaxially relative to the axis of the frame 84 and thus also in the assembled condition of the components in coaxial relationship with the pivot axis of the assembly, as indicated at 54 in FIGS. 4 and 9. The shaping portion 86 is fitted into the holder 88 in coaxial relationship therewith. The shaping portion 86 is releasably fixed to the holder 88 by way of plates 85 and screws 87 in the position in which the stencil 50 is stretched or tensioned into the shape of a truncated cone with the desired cone angle. At its side remote from the stencil 50, the shaping portion 86 is provided with a coaxial recess as indicated at 89 in FIGS. 9 and 10, into which, in the assembled condition of the arrangement, engages a fitting member 57 of suitable shape and size. The member 57 is provided with a tubular extension portion 90 which extends coaxially with respect to the axis of rotation 54 and which, with the interposition of bearing assemblies 92 for permitting rotary movement, is carried by a bridge 64 mounted to the machine frame structure. Also mounted on the member 57 which is connected to the shaped portion 86 in coaxial relationship with the axis of rotation 54 is a toothed segment 66 which meshes with a rack 67 (see FIGS. 4 and 9) which can be reciprocated in a horizontal plane so that a reciprocating movement of the rack 67 results in corresponding pivotal movements of the stencil 50 about the vertical axis of rotation 54.

Reference numeral 34 in for example FIGS. 4 and 9 identifies a doctor or squeegee member which co operates with the screen printing stencil 50 and which is arranged inclinedly in such a way that its lower boundary edge which is disposed opposite the highest region of the neck portion 12 of the bottle, at which the printing ink or like decorative agent is to be transferred on to same, extends at least substantially parallel to the surface of the neck portion 12 in that region. The squeegee member 34 is only reciprocatable in the direction indicated by the arrows 93 and 94 in FIG. 9 in such a way that, during the pivotal movement which provides for the print image to be applied to the neck portion 12 by the screen printing stencil 50, it elastically stresses the stencil 50 towards the neck portion 12 in the region of the stencil 50 which is opposite to the surface of the region of the neck portion 12 to which the print image or decoration is to be applied, whereby that region of the stencil 50 occupies the position required for the printing ink or other decorative agent to be transferred on to the neck portion. No later than at the beginning of the pivotal movement back into the starting position, in the reverse direction, the squeegee member 34 is moved back in the direction indicated by the arrow 93 to such an extent that the stencil 50 can return to its normal shape in which it is so far removed from the highest region of the neck portion 12 that there is no fear of contact between the stencil 50 and the following bottle which is to be moved into the printing station. A similar consideration also applies in regard to the co-operation of the screen printing stencil 52 for applying an image or decoration to the cylindrical portion 16 of the bottle 10 and the squeegee member 36 which co-operates therewith. In that way it is possible to avoid additional up and down movements of the stencil, and that can provide for an increase in the operating speed of the apparatus.

Reference numeral 68 in FIG. 9 identifies a carriage for carrying the printing device 48, the carriage being movable with a reciprocating motion perpendicularly to the plane of the drawing in FIG. 9. The carriage 68 is provided with a rack 71 which meshes with a pinion 96 which is driven in rotation by way of a shaft 95. The carriage 68 further carries a rack 97 meshing with a pinion 98 which produces the rotary movement of the bottle 10 about its longitudinal axis during the printing operation. The drive for the rack 67 for driving the printing device 46 is taken from the shaft 95 or a drive member connected thereto, thereby to ensure the necessary synchronism in regard to the movements of all the members which co-operate in the printing operation.

It will be noted that, with the above-described configuration and arrangement of the co-operating members, the screen printing stencil device 46 which serves for applying printing or decoration to the conical neck portion 12 of the bottle is disposed in a horizontal plane in which the reciprocating pivotal movements about the axis of rotation 54 are also performed. That means that the screen printing stencil does not project in any conceivable position of the components into the path of transportation movement of the bottles as they are transported through the station.

In a departure from the embodiment illustrated in the drawing the additional transportation device 70 may also be provided with a gripper or another arrangement which makes it possible for the bottle to be transported from the respective matching or register station such as 38 into the printing station disposed downstream thereof, without the orientation which is set up for the bottle in the matching or register station being altered in regard to its peripheral position.

In a further departure from the illustrated embodiment the conical surface to which the printing or decoration is to be applied does not need to extend over a peripheral extent of 360°. The invention is also suitable for applying decoration or printing to those surfaces which only define part of a cone whose cone surface extends for example only over a peripheral extent of 180° or otherwise.

It will be appreciated that, while the above-described embodiment has been set forth with reference to an operation of printing on or applying decoration to bottles, the method and apparatus according to the invention are not restricted to such articles, but can be used in any situation involving printing on or applying decoration to bottles which can be rolled against a screen printing stencil and whose radius of curvature changes more or less uniformly in the direction in which the co-operating squeegee member extends, thus for example in the direction of the longitudinal axis 44 of the bottles in the described embodiment.

Furthermore, the screen printing stencil may perform reciprocating movements with the printing or decoration-applying operation being effected in one direction of such movement, but it is possible for the screen printing stencil to be caused to rotate only in one direction, possibly with an intermediate stepping action.

It will be appreciated that the above-described method and apparatus according to the invention have been set forth solely by way of example and illustration of the principles of the present invention and that various modifications and alterations may be made therein without thereby departing from the spirit and scope of the present invention.

What is claimed is:

1. A method of applying printing to a conical surface of an article having a longitudinal axis and a cone angle measured between said surface and said axis, using at least one screen printing stencil provided with a print image on a region thereof, and a squeegee member co-operable with the stencil, the method comprising printing by rolling the article relative to the stencil, and pivoting the stencil, as the article rolls relative to the stencil, on an axis which extends at least substantially perpendicular to the longitudinal axis of the article, and, in pivoting the stencil, moving at least said region of the stencil provided with the print image in a path of movement which substantially describes a peripheral surface of a truncated cone whose cone angle is complementary to the cone angle of said conical surface, wherein said article is transported stepwise, in a transportation direction, into a matching station, from the matching station into a printing station, and out of the printing station after printing, and the article is oriented, by rotation on its longitudinal axis at the matching station, and, after orientation, is transported by an additional transportation means reciprocating between the matching station and the printing station, while maintaining its orientation, from the matching station into the printing station, the additional transportation means, when transporting an article from the matching station to the printing station, moving in the same direction as a transportation means which transports the article into the matching station prior to orientation and out of the printing station after printing.

2. A method as set forth in claim 1 wherein, during printing, said axis on which the stencil is pivoted is at least substantially vertical and the axis on which said article rolls relative to the stencil is at least substantially horizontal.

3. A method as set forth in claim 1 wherein, during an operating cycle, the stencil is maintained substantially at a fixed position along the length of said axis on which it is pivoted, and in which said region of the stencil on which the print image is provided, is engaged by said squeegee member to produce elastic deformation of said region of the stencil into a position at which a printing medium can be transferred from said region to said article.

4. A method as set forth in claim 1 wherein the stencil has a middle region surrounded by an edge region, and is mounted on a frame in such a way that it firstly extends in a plane, whereupon the middle region of the stencil is displaced relative to the frame with elastic deformation by a shaping portion which engages said middle region of the stencil in such a way that the edge region of the stencil is disposed, between the frame and the shaping portion, in said path of movement which substantially describes the peripheral surface of the truncated cone.

5. A method as set forth in claim 1 wherein the additional transportation means moves in the transportation direction synchronously with said transportation means which transports the article into the matching station prior to orientation and out of the printing station after printing.

6. A method as set forth in claim 1 wherein said print image is decoration.

7. Apparatus for applying printing to an article having a longitudinal axis, and a surface to be printed upon of a conical configuration, comprising holder means for holding and carrying the article during a printing operation and allowing rotary movement of the article; at least one screen printing stencil located at a printing station, and provided, on a region thereof, with at least one print image, the stencil being arranged pivotably about a pivot axis which extends at least substantially normal to the longitudinal axis of the article when the article is held by said holder means during printing, and at least the region of the stencil which is provided with the print image substantially forming at least part of the periphery of a truncated one whose angle, measured relative to the pivot axis of the stencil is complementary to the cone angle of said surface to be printed upon, measured relative to said longitudinal axis of said article; and at least one squeegee member, located on one side of the stencil, and co-operable with the stencil, and means for effecting movement of articles to be printed in a path extending through said printing station, said apparatus including, upstream of said printing station in the direction of movement of articles in said path, a matching register station, means, at the matching register station, for orienting each article, prior to application of a printing medium, by rotation of the article on its longitudinal axis, and said means for effecting movement of articles including a first transportation means for effecting stepping movement of the article into the matching station prior to orientation thereof and out of the printing station after printing thereon, and a second transportation means, reciprocatable between the matching station and the printing station, for effecting movement of articles from the matching station to the printing station, wherein the first transportation means effects stepping movement of said articles in steps of predetermined length, and in which said second transportation means is reciprocatable through a stroke substantially equal to said predetermined length of the steps of movement effected by the first transportation means.

8. Apparatus as set forth in claim 7 wherein said holding means is adapted to hold said article with its longitudinal axis extending at least substantially horizontally during the printing operation, and in which the axis about which the stencil is pivotable during the printing operation extends at least substantially vertically.

9. Apparatus as set forth in claim 7 including a frame carrying said stencil, a shaping portion disposed within said frame and adapted to bear against said one side of the stencil on which the squeegee member is located, the shaping portion projecting towards said article in such a way that it maintains said region of the stencil provided with the print image in the form of said at least part of the periphery of the truncated cone.

10. Apparatus as set forth in claim 9 wherein said frame is annular, and in which said shaping portion is of smaller diameter than said frame.

11. Apparatus as set forth in claim 9 including means for releasably mounting the shaping portion on the frame.

12. Apparatus as set forth in claim 11 wherein the mounting means is integral with the frame of the stencil.

13. Apparatus asset forth in claim 9 wherein the shaping portion is provided with a bore the longitudinal axis of which coincides with the pivot axis of the stencil.

14. Apparatus as set forth in claim 7 wherein the first transportation means and the second transportation means are moved synchronously in said path.

15. Apparatus as set forth in claim 14, wherein the second transportation means includes a suction means for holding the article to be transported out of the matching station into the printing station in its oriented position.

16. Apparatus as set forth in claim 14 wherein the second transportation means includes receiving elements for holding the article to be transported out of the matching station into the printing station in its oriented position.

* * * * *

UNITED STATES PATENT AND TRADEMARK OFFICE

CERTIFICATE OF CORRECTION

PATENT NO. : 5,317,967

DATED : June 7, 1994

INVENTOR(S) : Horst Heidenreich

It is certified that error appears in the above-identified patent and that said Letters Patent is hereby corrected as shown below:

Column 1, line 63, "apply" should read --applies--;
Column 3, lines 18 and 52, "elements" should read --movements--;
Column 3, line 41, "h=rolled" should read --be rolled--;
Column 4, line 47, "Look" should begin a new paragraph;
Column 5, line 24, after "station" insert --C.--;
Column 5, line 51, before "10" insert --bottle-;
Column 6, line 13, "for" should read --form--;
Column 7, line 48, "parking" should read --marking--;
Column 7, line 58, "are" should read --more--;
Column 8, line 50, "h=lifted" should read --be lifted--;
Column 9, line 28, after "the" insert --shape--;
Column 12, line 42, "one" should read --cone--;
Column 14, line 6 , "asset" should read --as set--.

Signed and Sealed this

Twentieth Day of September, 1994

*Attest:*

*Attesting Officer*

Bruce Lehman

BRUCE LEHMAN

*Commissioner of Patents and Trademarks*